United States Patent [19]

Baum

[11] 4,219,946

[45] Sep. 2, 1980

[54] SHOE WITH AN INTERCHANGEABLE HEEL

[76] Inventor: Uwe Baum, Rue Nanon 8,, 6060 Gilly, Belgium

[21] Appl. No.: 942,144

[22] Filed: Sep. 14, 1978

[30] Foreign Application Priority Data

Sep. 15, 1977 [BE] Belgium ..... 858729
Jan. 6, 1978 [BE] Belgium ..... 862705

[51] Int. Cl.[2] ..... A43B 21/36; A43B 13/28
[52] U.S. Cl. ..... 36/42; 36/24.5
[58] Field of Search ..... 36/42, 41, 36 R, 24.5

[56] References Cited

U.S. PATENT DOCUMENTS

| | | | |
|---|---|---|---|
| 2,057,703 | 10/1936 | Blake | 36/24.5 |
| 2,449,914 | 9/1948 | Simonetti | 36/42 |
| 2,943,404 | 7/1970 | Sultan | 36/42 |

FOREIGN PATENT DOCUMENTS

| | | | |
|---|---|---|---|
| 1135337 | 8/1962 | Fed. Rep. of Germany | 36/42 |
| 1156338 | 10/1963 | Fed. Rep. of Germany | 36/42 |

*Primary Examiner*—James Kee Chi
*Attorney, Agent, or Firm*—Robert E. Burns; Emmanuel J. Lobato; Bruce L. Adams

[57] ABSTRACT

A shoe with an interchangeable heel comprises two parts, a main sole part reinforced in its rear end section by a rigid plate and a separate heel part. The heel part is fitted to the reinforced section of the sole part by a ferrule, fixed to one part, having a projecting portion of non-circular cross-section which locates in an aperture of complementary shape in the other part so as to position and prevent rotation of the heel, and a removable locking element is provided to lock the heel part in place.

6 Claims, 7 Drawing Figures

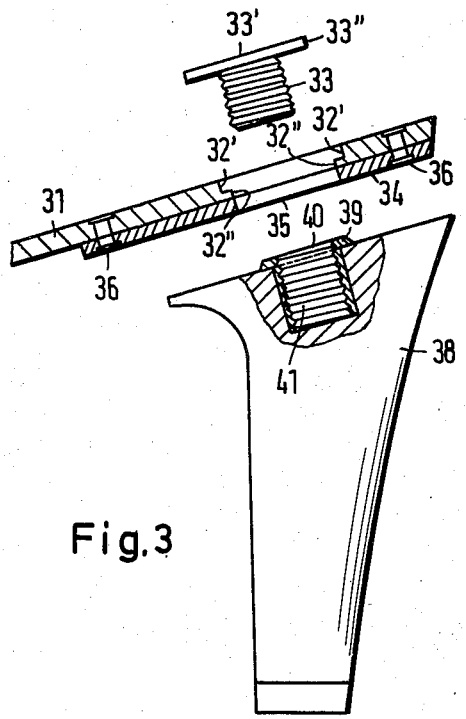
Fig.3
Fig.4
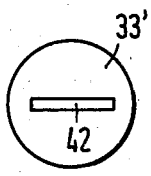
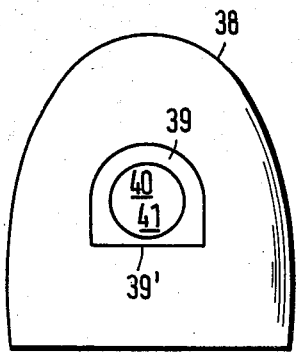
Fig.5
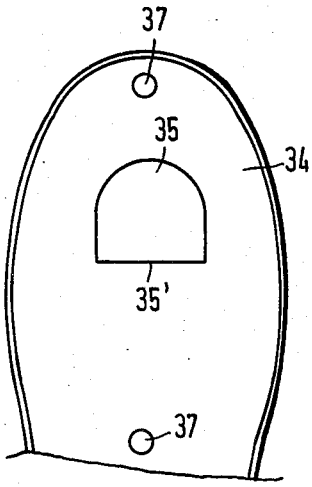
Fig.6
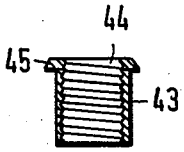
Fig.7

SHOE WITH AN INTERCHANGEABLE HEEL

FIELD OF INVENTION

The present invention concerns a construction of shoes with interchangeable heels.

BACKGROUND OF THE INVENTION

It is more and more desirable to be able, on the same pair of shoes, to change the heels in order to adapt them every time to the other items of clothing; furthermore, it is equally rational to have available at least two pairs of spare heels for a pair of shoes; the heels, in particular when they are stiletto type heels, being fragile and wearing out more rapidly than the other parts of the shoe.

Even though different solutions have already been evisaged, none have satisfied the two essential criteria: easy manufacture, and perfect adhesion of the heel to the shoe sole to which it is fixed.

SUMMARY OF THE INVENTION

In the present invention there is provided a construction of shoes with interchangeable heels, characterized by the fact that on one hand the main sole comprises, at its rear end, a reinforcement consisting of a rigid plate fixed to it, and the main sole as well as the plate are both cut out or apertured facing each other, the cut-out in the plate being, however, smaller than that in the sole and also the cut-out in the upper part of the sole being bigger than the one in the lower part of the said sole, and one of these cut-outs having at least a corner cut straight or being provided with an eccentric (non-circular) portion, and on the other hand, the heel at its upper end comprises or is provided with a ferrule capable of passing through these cut-outs, the heel, and the main sole being joined together by means capable of being removed or unscrewed.

BRIEF DESCRIPTION OF DRAWING

Different embodiments are possible starting from this characteristic and two particularly useful embodiments will be described and depicted here below, by way of example and without limitation, with reference to the attached drawing in which:

FIG. 3 shows diagrammatically a side view partly broken away and in section, of the different pieces provided for according to a second embodiment;

FIG. 4 shows diagrammatically a view from above of the screw shown in FIG. 3;

FIG. 5 shows diagrammatically a view from above of the heel shown in FIG. 3;

FIG. 6 shows diagrammatically a view from underneath of the reinforcement plate shown in FIG. 3;

FIG. 7 shows diagrammatically a sectional view through a metal sleeve shown in FIG. 3.

DESCRIPTION OF PREFERRED EMBODIMENT

Figure 1:
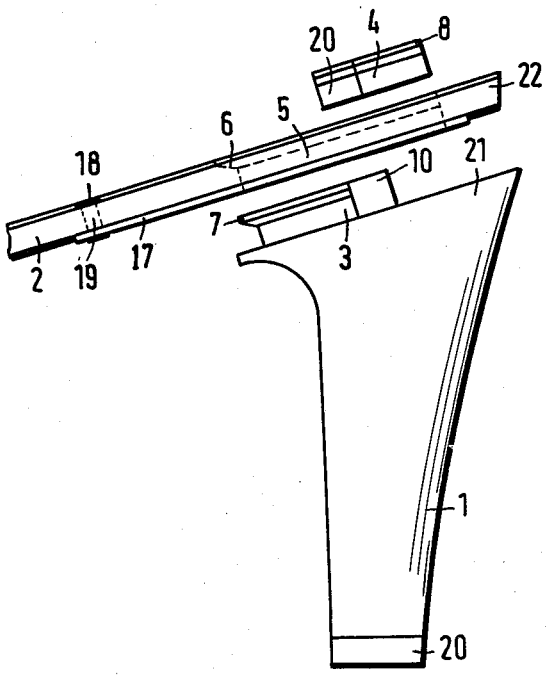
FIG. 1 shows diagrammatically a partial side view, partly broken away and in section, of the construction according to a first embodiment, the different pieces being shown before assembly.
Figure 2:
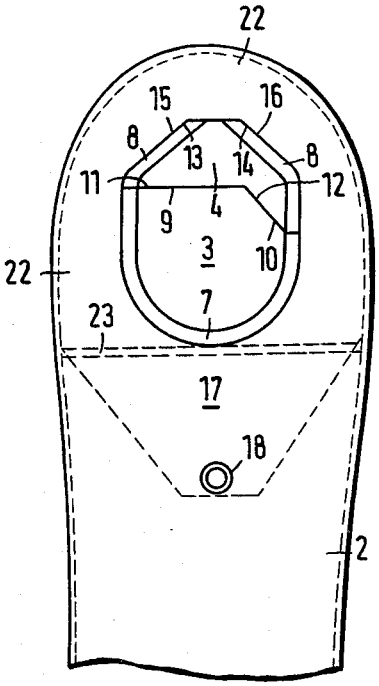
FIG. 2 shows diagrammatically a partial view from above of the same arrangement as in FIG. 1, the different pieces being assembled together.

In FIGS. 1 and 2 we have indicated the heel 1, the first sole 2, the ferrule 3 (FIG. 1) integral with the heel 1, the clamping wedge 4, and the cut out 5 in the main sole 2.

In order to ensure that the different pieces are perfectly held together once they are assembled, they have the following characteristics:

the cut-out 5 in the sole 2 is provided with a supporting recess 6, cut away from the upper part of the cut-out 5 such recess 6 extending partially or completely around the periphery of the cut-out 5.

the ferrule 3 is provided with a positioning flange 7, protruding laterally and destined to rest in the supporting recess 6.

the clamping wedge 4 is similarly provided, but only on its lateral sides, with a positioning flange 8, protruding laterally and destined to be placed on the supporting recess 6.

In order to allow the passage of the ferrule 3 through the cut-out 5, in spite of its protrusion 7, it is necessary for example, as shown in FIG. 1, to engage only the front part of the cut-out; we must nevertheless point out that it is desirable for the ferrule 3 to engage a substantial part of the cut-out 5 in order to provide a supporting surface sufficient for the level of loads encountered by the shoe. Also for this reason, the cut-out 5 must be equally be relatively substantial.

It is possible to allow the ferrule 3 to enter in spite of a width at the level of its protrusion 7 greater than the width of the cut-out 5 at the level of its cut away recess 6, in passing this ferrule 3 through the cut-out 5 and in inserting the ferrule 3 in the cut-out 5, by presenting it perpendicularly to the latter and by subsequently turning it through a half turn when its protrusion 7 is above the cut away recess 6; obviously there are other solutions possible such as for example to provide a cut-out (not shown) which is enlarged towards the rear and to present the ferrule to the rear of the cut-out and subsequently to advance it forwards.

In FIGS. 1 and 2 we see that the ferrule 3 presents to the rear a face with cut off corners 9 and 10; similarly the front of the clamping wedge 4 has cut off corners 11 and 12 and the rear of the said clamping wedge 4 is angular, that is, with cut off corners 13 and 14 in line with the rear straight angled sides 15 and 16 of the cut-out 5, since a rounded shape would not enable to prevent the rotation of the heel 1 with respect to the sole 2.

In FIGS. 1 and 2 we see also a rigid plate 17 made of particularly rigid material, of aluminium for example, which reinforces the rear of the sole 2 and in particular the part of the sole 2 including the cut-out 5; this plate 17 will be fixed to the sole 2 for example by cementing and by a rivet 18 passing through the hole 19 which exists already in the case of injection-moulded soles. As in the case of a heel of the "stiletto" type, it is desirable that not only the ground contact end 20 of the heel 1 be particularly slender but equally that the heel 1 presents an enlargement 21 towards the top as small as possible; at the level of the ferrule and opposite the corresponding part of the sole 2, we have available only a limited surface area whereas on the contrary we cannot reduce the surface area of the ferrule 3 to a value too small and anyway the peripheral surface of the cut-out 5 is equally limited, given that we must preserve all around it a sufficient bearing surface 22; it is important therefore that the surface of the ferrule 3 be the largest possible with respect to the cut-out 5; for this reason, as indicated herebefore, we provide for the introduction at right angles of the ferrule 3 in order to facilitate this movement; we can provide an abutment point or line (not shown) on the underlying part of the sole 2, located approximately on the dotted line 23 (FIG. 2), which will facilitate the placing in position of the ferrule 3 in the cut-out 5.

With reference to FIG. 3 we have indicated part of the main sole 31 provided with its cut-out 32, a right-handed screw 33 having a flat head 33', a rigid plate 34, generally made of metal, for reinforcing the main sole 31, provided with a cut-out 35 and fixed to the said sole for example by two rivets 36, for accepting which it comprises two holes 37 (FIG. 6), a heel 38 having at its upper end a ferrule 39 comprising a round cavity 40 followed, in the heel 38 itself, by a threaded cavity 41. As visible in FIG. 4, the flat head 33' of the screw 33 is circular and comprises a straight slot 42, internally longitudinally curved (not shown), enabling to introduce in it a circumferential segment of a flat round piece, for example, a coin which everbody possesses at all times. Furthermore, as visible in FIG. 3, the flat head 33' has a square cut edge 33" in order to enable it to sink into the cut-out 32 of the sole 31; the latter is equally round and with circumferential dimensions just greater than those of the head of the screw 33, but only the upper part 32' of the cut-out 32, over a sufficient depth, is nearly of the same diameter as the head 33' of the screw whereas the lower part 32" has a smaller diameter so that the screw 33 is stopped at the bottom of the cut-out 32.

The cut-out 35 of the reinforcing plate 34 which is intended to receive the ferrule 39 of the heel 38 will have therefore a peripheral dimension slightly larger than the said ferrule 39. The shape of the cut-out 35, as of the ferrule 39, can be curved or even circular over nearly all the length of its periphery but with at least a cut off corner, respectively 35' (FIG. 6) in the cut-out 35 and 39' (FIG. 5) in the ferrule 39, in order to give it a non-circular configuration to prevent rotation of the heel 39 with respect to the sole 31. It is understood that we could provide a cut-out 35 to match a ferrule 39 of angular form, for example square or rectangular.

In order to limit the length of the screw 33, but still retain a sufficient bearing height, the threading can then start on the internal walls of the cavity 40 of the ferrule 39, before continuing in the cavity 41 of the heel 38.

As visible in FIG. 7, the ferrule 39 and the cavities 40 and 41 can be provided by means of an upright sleeve 43 comprising a thread 44 and, at the upper end, a laterally protruding flanges 45 having also (not shown) a cut off corner and being also of angular form.

Preferably, the edges of the ferrule 39 (or flange 45) will be slightly conical in order to promote the clamping of the heel 38 onto the sole 31.

There is reason for pointing out that the drawing attached hereto gives only a diagrammatic idea by way of example of an embodiment according to the invention; we have in effect neglected to show the slight transverse curvature which we meet in practice on the sole 2 or 31 as well as on the top of the heel 1 or 38. Because of the transverse curvature, the reinforcing plate 17 or 34, whose width is, as shown in the Figures, smaller at the head of the heel 1 or 38, will not prevent the upper external edge of the heel 1 of 38 from bearing against the lower external edge of the sole 2 or 31.

The present invention is not limited to the form of embodiment described and illustrated, and one will not depart outside its scope by adding some modifications to it, for example, by inverting the fixing of the heel to the sole, that is, by providing a ferrule under the reinforcing plate and an adequate cut-out at the top of the heel, such cut-out being in such case prolonged by a cavity with a smaller periphery. In another modification we can equally provide for the reinforcing plate 17 or 34 to be countersunk in the sole 2 or 31 at the time the latter is being manufactured; this plate in such case could be nothing more than a simple metal washer having greater or smaller dimensions according to the type of embodiment.

In particular, in the case of the second embodiment, if we envisage mass producing the different pieces of the structure by moulding: the ferrule 39 will simply be a rim protruding from the heel (ferrule provided with an eccentric expansion (non-circular contour) which will prevent the heel from turning), the main sole 31 will have countersunk in it a reinforcing plate, both comprising a circular cut-out of which at least one is provided with a laterally eccentric expansion (notch), and the screw itself could be formed by moulding.

What is claimed is:

1. A construction of shoes with interchangeable heels comprising:

a main sole having in a heel portion thereof a counter sunk circular hole comprising a lower portion of smaller diameter and an upper portion of larger diameter, a reinforcing plate fixed on the lower side of the heel portion of said sole, said plate having a non-circular hole registering with but larger than the lower portion of said hole in said sole, a heel having an upper surface fitting against the lower side of the heel portion of said sole, said heel having a tapped hole extending down from said upper surface and aligned with said hole in said sole, a non-circular ferrule fixed to said heel and projecting up from said upper surface of said heel, said ferrule having an opening registering with said tapped hole in said heel and a non-circular outer periphery received in said non-circular hole in said plate to secure said heel against turning relative to said sole, and a screw having a threaded shank received in said tapped hole in said heel and a head received in said upper larger portion of said hole in said sole, said screw extending through said holes in said sole and said plate and being screwed into said tapped hole in said heel to secure said heel removably and replaceably to said sole.

2. A shoe construction according to claim 1, in which said tapped hole is provided by an internally threaded sleeve set in said heel, and said ferrule comprises a flange at the upper end of said sleeve.

3. A shoe construction according to claim 1, in which the outer periphery of said ferrule is bevelled so as to wedge in said hole in said plate when said screw is screwed into said tapped hole.

4. A shoe construction according to claim 1, in which said head of said screw has a flat upper surface with a transverse slot therein.

5. A shoe construction according to claim 1, in which said hole in said plate and the outer periphery of said ferrule have a shape which is in part an arcuate curve concentric with said hole in said sole and in part a flat side.

6. A shoe construction according to claim 1, in which said plate is metal.

* * * * *